US008867907B2

(12) United States Patent
Penton

(10) Patent No.: US 8,867,907 B2
(45) Date of Patent: Oct. 21, 2014

(54) RESERVOIR FLUID HEATING DEVICES AND METHODS OF HEATING

(71) Applicant: Chevron USA, Inc., San Ramon, CA (US)

(72) Inventor: John David Penton, Houston, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 147 days.

(21) Appl. No.: 13/651,158

(22) Filed: Oct. 12, 2012

(65) Prior Publication Data

US 2014/0105585 A1 Apr. 17, 2014

(51) Int. Cl.
*F24H 1/20* (2006.01)
*H05B 3/78* (2006.01)

(52) U.S. Cl.
USPC ..... 392/455; 392/459; 392/453

(58) Field of Classification Search
None
See application file for complete search history.

(56) References Cited

U.S. PATENT DOCUMENTS 1,379,671 A * 5/1921 Abtmeyer ..... 219/534
1,692,869 A * 11/1928 Scanlan ..... 392/453
1,968,549 A * 7/1934 Allen ..... 392/452
2,429,303 A 10/1947 Apatow
2,437,453 A * 3/1948 Belgau ..... 392/456
3,170,511 A 2/1965 Guthrie
3,717,748 A 2/1973 Imler
4,403,137 A * 9/1983 Glazer ..... 392/452
4,514,617 A * 4/1985 Amit ..... 392/452
4,584,463 A 4/1986 Klages et al.
4,587,401 A * 5/1986 Ekman ..... 392/495
5,736,059 A 4/1998 Mackelvie et al.
5,878,192 A * 3/1999 Jackson ..... 392/452
6,321,036 B1 * 11/2001 Huang ..... 392/453
6,936,798 B2 * 8/2005 Moreno ..... 219/492
7,997,236 B2 * 8/2011 Pussell ..... 122/13.01
2010/0092164 A1 4/2010 Ziehm

FOREIGN PATENT DOCUMENTS

GB 2468015 8/2010

* cited by examiner

*Primary Examiner* — Thor Campbell

(57) ABSTRACT

A heater assembly for a fluid reservoir includes an outer housing coupled to a flange on the fluid reservoir, an inner tubular member disposed within the outer housing, the inner tubular member having a central passageway therethrough, wherein an annulus is formed between the outer housing and the inner tubular member, and a heating device coupled to a lower end of the outer housing and having heating elements which extend upwardly into the central passageway of the inner tubular member.

20 Claims, 1 Drawing Sheet

RESERVOIR FLUID HEATING DEVICES AND METHODS OF HEATING

FIELD OF THE INVENTION

Embodiments of the present disclosure relate to apparatus and methods to heat a reservoir fluid, for example in air-cooled heat exchangers, or similar structures.

BACKGROUND

Air-cooled heat exchanger tubes exposed to low ambient air temperatures (e.g., below 32° F.) will freeze rapidly if the tubes are filled with water as with a water cooler or steam condenser. There is often no way to insulate such finned air cooler tubes. In one or more embodiments herein, an apparatus is provided that solves this problem by utilizing a heater assembly that may be attached to a drain connection on the air cooler heater.

In one aspect, embodiments disclosed herein relate to a heater assembly for a fluid reservoir including an outer housing coupled to a flange on the fluid reservoir, an inner tubular member disposed within the outer housing, the inner tubular member having a central passageway therethrough, wherein an annulus is formed between the outer housing and the inner tubular member, and a heating device coupled to a lower end of the outer housing and having heating elements which extend upwardly into the central passageway of the inner tubular member.

In other aspects, embodiments disclosed herein relate to a heat exchanger including a fluid reservoir and a heater assembly coupled to the fluid reservoir, the heater assembly including an outer housing, an inner tubular member disposed within the outer housing, the inner tubular member having a central passageway therethrough, wherein an annulus is formed between the outer housing and the inner tubular member, and a heating device coupled to a lower end of the outer housing and having heating elements which extend upwardly into the central passageway of the inner tubular member.

In yet other aspects, embodiments disclosed herein relate to a method of heating water in a fluid reservoir including coupling a heater assembly to the fluid reservoir, the heater assembly including an outer housing, an inner tubular member disposed within the outer housing, the inner tubular member having a central passageway therethrough, wherein an annulus is formed between the outer housing and the inner tubular member, and a heating device coupled to a lower end of the outer housing and having heating elements which extend upwardly into the central passageway of the inner tubular member. The method further includes heating water present in the central passageway of the inner tubular member, wherein heated water exits from an upper end of the inner tubular member and circulating unheated water from the fluid reservoir downward through the annulus and into the central passageway of the inner tubular member.

BRIEF DESCRIPTION OF THE DRAWING FIGURES

A more complete appreciation of the subject matter of the present invention and the various advantages can be realized by reference to the following detailed description in which reference is made to the accompanying drawings in which.

DETAILED DESCRIPTION

Embodiments disclosed herein relate to reservoir fluid heating devices and related methods of heating a reservoir fluid. In certain embodiments, a heater assembly that may be useful for heating a reservoir fluid to a temperature above the fluid freeze point is provided.

Figure 1:
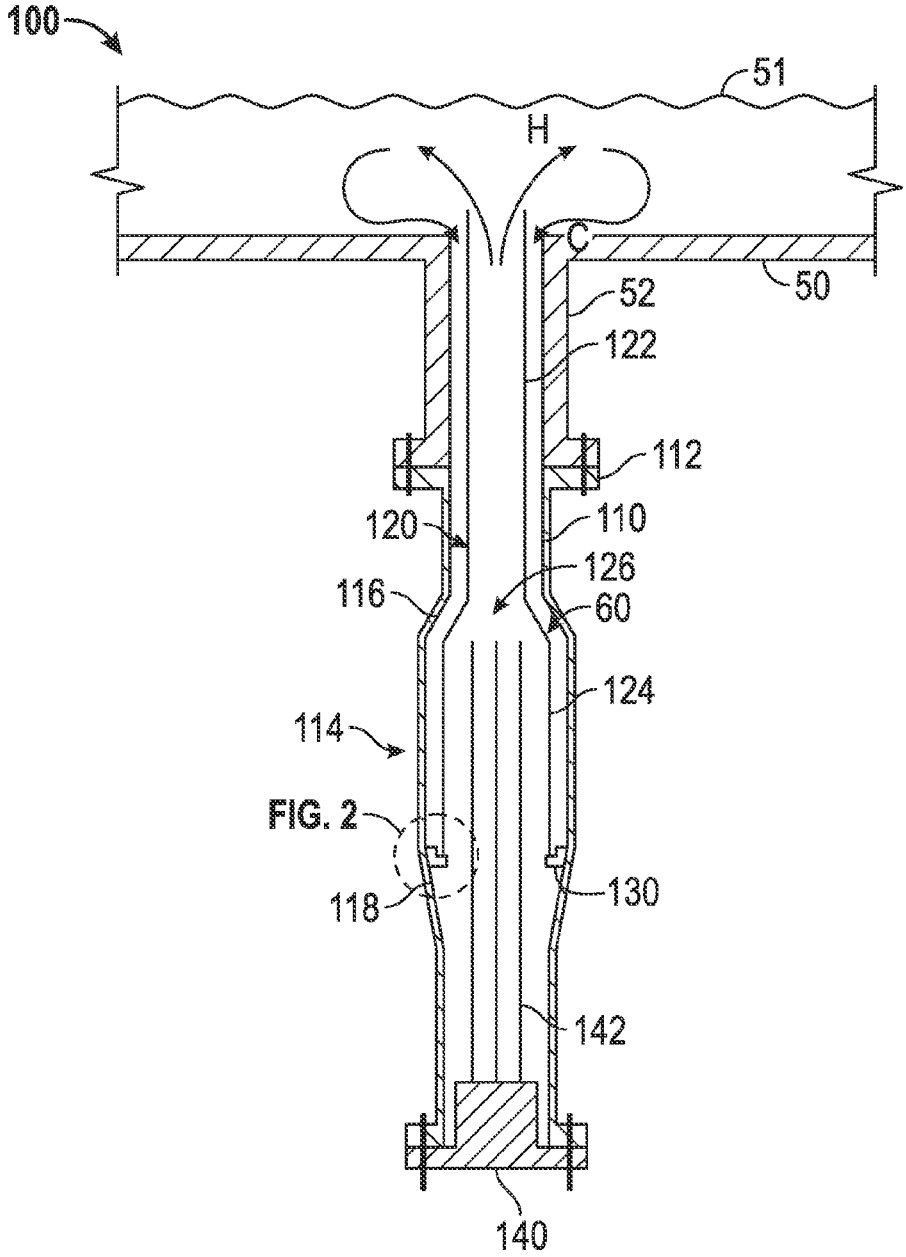
FIG. 1 illustrates a cross-section view of a heater assembly in accordance with one or more embodiments of the present disclosure.

Referring to FIG. 1, a cross-section view of a heater assembly 100 in accordance with one or more embodiments of the present disclosure is shown. The heater assembly 100 includes an outer housing 110. In certain embodiments, the outer housing 110 may have a generally cylindrical cross-section. The outer housing 110 has a flange surface 112 on an end thereof that abuts a reservoir 50 via a flange assembly 52. For example, one or more threaded fasteners (not shown) may be used to secure the outer housing flange 112 to the flange assembly 52 of the reservoir 50. Other means of attachment may also be used in accordance with one or more embodiments, including, but not limited to welding, brazing, and other methods of attachment known to one of ordinary skill in the art. The outer housing 110 may have a length of at least about 12 inches, or 16 inches, or 18 inches, up to about 24 inches, or 28 inches, or 32 inches.

In certain embodiments, an inner diameter of the outer housing 110 may vary along its length. For example, an upper angular portion 116 may provide a step up in diameter to an enlarged region 114 of the outer housing 110. In certain embodiments, the outer housing 110 may have an upper angular portion 116 that provides a step up in inner diameter from at least about 1 inch, 2 inches, 2½ inches, 3 inches, or 3½ inches, up to about 4 inches, 4½ inches, 5 inches, 5½ inches, or 6 inches.

Still further, the outer housing 110 may have a lower angular portion 118 which provides a step down in diameter from the enlarged region 114 to a lower end of the outer housing 110. The lower angular portion 118 may be considered inwardly angled moving downward in an axial direction from the enlarged region 118 to a lower end of the outer housing 110. In certain embodiments, the lower angular portion 118 may provide a step down in inner diameter from at least about 5½ inches, 5 inches, 4½ inches, or 4 inches to about 3½ inches, 3 inches, 2½ inches, or 2 inches. In other embodiments, the outer housing 110 may have a constant diameter along its length (not shown). The outer housing 110 may be manufactured from carbon steel or stainless steel tubing, although one of ordinary skill in the art will be familiar with other corrosion resistant materials that may be used. Outer housing 110 may be manufactured using material that meets standards prescribed by ASME Section II or any other similar Code known to one of ordinary skill in the art.

The heater assembly 100 further includes an inner tubular member 120 disposed within the outer housing 110 and which extends lengthwise concentrically there within. An upper tubular section 122 of the inner tubular member 120 is configured to fit within a bore of the flange assembly 52 of reservoir 50. As shown, the upper tubular section 122 may extend upward into the fluid reservoir 50, an end of the upper tubular section 122 extending past an inner wall of fluid reservoir 50. For example, the end of the tubular section 122 may extend past inner wall of the fluid reservoir by about ¼ inch or ½ inch, and up to about 1 inch, 2 inches, or 5 inches. Alternatively, an end of the tubular section 122 may be even with inner wall of the fluid reservoir 50 (i.e., a plane at an end of the tubular section and perpendicular to a central axis of the tubular section coplanar with an inner wall of the fluid reservoir 50). One or more guides (not shown) may be disposed between the upper tubular section 122 and an inner wall of the outer housing 110 to center the upper tubular section 122 there within. For example, the guides may be sheet metal or key stock attached to the upper tubular section 122. In any event, an outer diameter of the inner tubular member 120 is less than an inner diameter of the outer housing 110. A lower end 124 of the inner tubular member 120 may have a larger diameter that fits within the enlarged region 114 of the outer housing 110. For example, the inner tubular member 120 may have an angular section that transitions from upper end 122 to the enlarged lower end 124. In certain embodiments, the enlarged region of the inner tubular member 120 may be about 2 inches, 2½ inches, 2¾ inches, 3 inches, 3¼ inches, or 3½ inches. The inner tubular member 120 may be manufactured from stainless steel tubing, although one of ordinary skill in the art will be familiar with other corrosion resistant materials that may be used.

The inner tubular member 120 may be held in place relative to the outer housing 110 by a set of support clips 130 at a lower end 124 of the inner tubular member 120. The support clips 130 may be positioned at the lower angular portion 118 of the outer housing 110 so that the lower end 124 of the inner tubular member 120 sits on the support clips 130. Any number of support clips 130 may be used. For example, in certain embodiments, four support clips may be spaced evenly around a circumference of the lower end of the inner tubular member 120. In other embodiments, as few as two or three support clips 130 may be used, or as many as six, eight, or more support clips may be used. The support clips 130 may be spaced evenly or unevenly around a circumference of the inner tubular member 120 as determined by one of ordinary skill in the art. In certain embodiments, the support clips may be constructed of stainless steel, although one of ordinary skill in the art will be familiar with other corrosion resistant materials that may be used.

Figure 2:
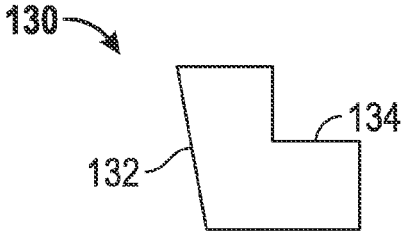
FIG. 2 illustrates a side view of a support clip used in accordance with one or more embodiments of the present disclosure.

FIG. 2 illustrates a support clip 130 in greater detail in accordance with one or more embodiments of the present disclosure. As shown, the support clip 130 has an angled edge 132 that corresponds with the lower angular surface 118 of the outer housing 110. Additionally, the support clip 130 may have a lip 134 on which the lower end 124 of the inner tubular member 120 rests. When assembled, the angled edge 132 of the support clip 130 is attached to the lower angular surface 118 of the outer housing 111. Then, the lower end 124 of the inner tubular member 120 contacts and rests on the lip 134 of the support clip 130. Thus, the inner tubular member 120 is prevented by the support clips 130 from moving downward relative to the outer housing 110.

In certain embodiments, the support clips 130 may be secured to the outer housing 110 and inner tubular member 120, for example, with an adhesive such as epoxy. Otherwise, the support clips may be welded or brazed and attached to one or more of the outer housing 110 and inner tubular member 120. In other embodiments, the support clips may be welded to only the outer housing 110.

Referring back to FIG. 1, an annulus 60 is defined between the outer housing 110 and the inner tubular member 120 for fluid flow within the heater assembly 100. Fluid flow through the annulus 60 may reach a central passageway 126 within the inner tubular member 120 through the open lower end 124 of the inner tubular member 120. The interior of inner tubular member 120 defines the central passageway 126 which will also be for fluid flow within the heater assembly 100. As shown, an inlet to the annulus 60 is adjacent to an exit from the central passageway 126 of the inner tubular member 120.

The heater assembly 100 further includes a heating device 140 connected to a lower portion of outer housing 110, typically with a flange assembly as shown. For example, one or more threaded fasteners may be used to secure the heating device 140 to a lower end of the outer housing 110. Other means of attachment may also be used in accordance with one or more embodiments, including, but not limited to welding, brazing, and other methods of attachment known to one of ordinary skill in the art. The heating device 140 may include one or more heating elements 142 that extend into the outer housing 110 and a lower end 124 of the inner tubular member 120. The heating elements 142 extend into a portion of central passageway 126 of inner tubular member 120. In certain embodiments, the heating elements 142 may have a maximum heated length of about 8 inches, 10 inches, 12 inches, or up to 14 inches. In still further embodiments, heating elements 142 may have a maximum heated length of up to about 36 inches.

The heating device 140 may be an electric heating element having a separate electrical source (not shown). In one embodiment, the heating device 140 may be an immersion heater, such as those available from Chromalox® Precision Heat and Control, located in Pittsburgh, Pa.

Methods of using the heater assembly 100 are described in reference to FIG. 1 in accordance with one or more embodiments of the present disclosure. Fluid 51 is carried within reservoir 50. When the heater assembly 100 is off (i.e., heating device 140 is turned off), fluid may flow from reservoir 50 into heater assembly 100 through both the annulus 60 and the central passageway 126 of the inner tubular member 120. In accordance with one or more embodiments disclosed herein, fluid reservoir may contain stagnant fluid such as in a fluid tank, or fluid flowing through, for example, a pipe or conduit.

However, when the heating device 140 is turned on, heating elements 142 may transfer heat to the fluid in the passageway 126 of the inner tubular member 120. This causes the fluid within the passageway 126 to heat up. Thus, heated fluid 'H' will exit the upper end of inner tubular member 120 into fluid 51. The hotter water will naturally rise, and therefore cause the cooler water to circulate downward. The cold fluid "C" may enter the annulus 60 and flow downward until it reaches the area in which the heating elements 142 extend. The process continues as water is heated and rises to exit from the upper end of the inner tubular member 120 back into fluid 51. In one or more alternate embodiments, one or more heating elements 142 may extend into the annulus 60 such that fluid is heated in the annulus 60 and unheated fluid circulates downward through the central passageway 126.

In accordance with one or more embodiments disclosed herein, the heating device 140 may heat fluid in the central passageway by at least about 2° F., 4° F., 6° F. and up to about 16° F., 20° F., or 25° F. Otherwise, the heating device 140 may raise a fluid temperature to about 2, 5, or 10 degrees above an ambient temperature.

Heater assembly 100 as described herein may be used in any number of arrangements to heat a reservoir fluid. For example, heater assembly 100 may be used on air-cooled heat exchangers for freeze protection. The heater assembly may be installed onto any existing flange not being used on the heat exchanger and that provides access to fluid flowing through the heat exchanger. Similarly, the heater assembly might be used on other common types of heat exchangers such as shell & tube heat exchangers, double-pipe or multi-tube heat exchangers. Additionally, the heater assembly described herein may be retrofit on any number of fluid reservoirs or equipment. One of ordinary skill in the art will appreciate that any number of heater assemblies may be attached to a fluid reservoir to provide sufficient freeze protection (i.e., fluid heating) as required for a given ambient temperature or fluid type. Additionally, one of ordinary skill in the art will be familiar with suitable heater assembly sizing to deliver enough heat to overcome heat losses from the fluid reservoir.

Advantageously, a heater assembly described herein provides freeze protection for expensive fluid handling equipment, such as heat exchangers. Damage to equipment due to a reservoir fluid freezing is thereby avoided and costly repair and maintenance is reduced or prevented. Additionally, the heater assembly may be of great benefit as a retrofit to existing equipment where the original design was in jeopardy of freezing. Thus, the heat exchangers may operate in regions with lower ambient temperatures with relatively little added cost.

Although only exemplary embodiments are specifically illustrated and described herein, it will be appreciated that many modifications and variations of the process and apparatus described herein are possible in light of the above teachings and within the purview of the appended claims without departing from the spirit and intended scope of the claimed subject matter.

What is claimed is:

1. A heater assembly for a fluid reservoir, the heater assembly comprising:

an outer housing coupled to a fluid reservoir opening;

an inner tubular member disposed within the outer housing, the inner tubular member having a central passageway therethrough, a lengthwise portion of the central passageway having a larger diameter than the fluid reservoir opening;

wherein an annulus is formed between the outer housing and the inner tubular member; and a heating device coupled to a lower end of the outer housing and having heating elements which extend upwardly into the central passageway of the inner tubular member.

2. The heater assembly of claim 1, further comprising at least one support clip being disposed between the outer housing and the inner tubular member. which supports a lower end of the inner tubular member.

3. The heater assembly of claim 2, wherein the at least one support clip is fastened to an inner diameter of the outer housing.

4. The heater assembly of claim 2, wherein the at least one support clip comprises a lip on which a lower end of the inner tubular member rests.

5. The heater assembly of claim 1, wherein the heating elements have a heated length of up to about 10 inches.

6. The heater assembly of claim 1, wherein the outer housing comprises an enlarged region having an inner diameter of between about 3 inches and 5 inches.

7. The heater assembly of claim 1, wherein the inner tubular member comprises an enlarged lower end having an outer diameter of between about 2 and 4 inches.

8. The heater assembly of claim 1, wherein the heating device is an immersion heater.

9. The heater assembly of claim 1, wherein an inlet to the annulus is adjacent to an exit from the central passageway of the inner tubular member.

10. The heater assembly of claim 1, wherein the fluid reservoir is in a heat exchanger.

11. The heater assembly of claim 1, further comprising at least one guide member disposed between an upper tubular section of the inner tubular member and the outer housing.

12. A heat exchanger comprising:

a fluid reservoir; and a heater assembly coupled to an opening in the fluid reservoir, the heater assembly including:

an outer housing;

an inner tubular member disposed within the outer housing, the inner tubular member having a central passageway therethrough, a lengthwise portion of the central passageway having a larger diameter than the opening;

wherein an annulus is formed between the outer housing and the inner tubular member; and a heating device coupled to a lower end of the outer housing and having heating elements which extend upwardly into the central passageway of the inner tubular member.

13. The heat exchanger of claim 12, wherein the outer housing of the heater assembly is coupled to a flange of the fluid reservoir.

14. The heat exchanger of claim 12, further comprising at least one support clip being disposed between the outer housing and the inner tubular member, which supports a lower end of the inner tubular member.

15. The heat exchanger of claim 12, wherein the heating device is an immersion heater.

16. The heat exchanger of claim 12, wherein an inlet to the annulus is adjacent to an exit from the central passageway of the inner tubular member.

17. A method of heating water in a fluid reservoir, the method comprising:

coupling a heater assembly to an opening of the fluid reservoir, the heater assembly including:

an outer housing;

an inner tubular member disposed within the outer housing, the inner tubular member having a central passageway therethrough, a lengthwise portion of the central passageway having a larger diameter than the opening;

wherein an annulus is formed between the outer housing and the inner tubular member; and a heating device coupled to a lower end of the outer housing and having heating elements which extend upwardly into the central passageway of the inner tubular member;

heating water present in the central passageway of the inner tubular member, wherein heated water exits from an upper end of the inner tubular member; and circulating unheated water from the fluid reservoir downward through the annulus and into the central passageway of the inner tubular member.

18. The method of claim 17, further comprising actuating the heating device and transferring heat from heating elements to fluid in the central passageway of the inner tubular member.

19. The method of claim 17, further comprising circulating unheated water into the central passageway as heated water leaves the central passageway.

20. The method of claim 17, further comprising heating fluid in the central passageway at least about 5 degrees above an ambient temperature.

* * * * *